United States Patent [19]

Penick

[11] Patent Number: 4,784,314

[45] Date of Patent: Nov. 15, 1988

[54] DECORATIVE PAPERBOARD BOXES

[75] Inventor: Ib Penick, Palatine, Ill.

[73] Assignee: Stuctural Graphics Inc., Essex, Conn.

[21] Appl. No.: 72,547

[22] Filed: Jul. 13, 1987

[51] Int. Cl.[4] ..... B65D 5/42

[52] U.S. Cl. ..... 229/8; 40/312; 206/457; 229/922

[58] Field of Search ..... 229/8, 922, 92.8; 206/457, 459, 44 R; 40/312, 313

[56] References Cited

U.S. PATENT DOCUMENTS

| | | | |
|---|---|---|---|
| 953,593 | 3/1910 | Brown | 229/8 |
| 1,684,244 | 9/1928 | Richardson | 229/8 |
| 2,089,563 | 8/1937 | Luhrs | 229/8 |
| 2,511,211 | 6/1950 | Klein et al. | 40/312 |
| 2,550,417 | 4/1951 | Klein | 229/8 |
| 3,224,660 | 12/1965 | Willis et al. | 229/8 |

FOREIGN PATENT DOCUMENTS

| | | | |
|---|---|---|---|
| 20629 | of 1899 | United Kingdom | 229/92.8 |
| 479780 | 2/1938 | United Kingdom | 229/8 |

*Primary Examiner*—Stephen Marcus
*Assistant Examiner*—Gary E. Elkins
*Attorney, Agent, or Firm*—Fitch, Even, Tabin & Flannery

[57] ABSTRACT

A folding paperboard gift box having a generally square or rectangular cross section enclosure formed by four wall panels and closed at both ends by suitable end closures, which may constitute interconnecting end panels. Hingedly attached to one of these panels is a decorative design element. Upon the setting up or squaring or the closing of the box, this design element becomes spaced-apart from the surface of the panel from which it is attached and thus stands out prominently as a part of the completed box.

4 Claims, 3 Drawing Sheets

63'
67a
65d
75
63
65a
71
75
73
67b
70
69

63'
65a
71
75
65d
63
75
70
69
67b 81
93a
85c
87b
85e
83
87b
93b
87a
93c
89
85a
91

81
85d
85c
16
93a
87a
93b
85b
93c
83
85a
16

87a
93c
93b
93a
91
83

93a
85c
83
85e
87a
87b
87b
85a
91
89

DECORATIVE PAPERBOARD BOXES

The present invention relates to foldable paperboard gift boxes, and more particularly to a gift box of this general type wherein a separate design panel stands apart from the box itself and is displayed exterior of the set-up gift box.

BACKGROUND OF THE INVENTION

A variety of gift boxes are provided to customers which are used for holiday gifts, birthday gifts, anniversary gifts and the like. Decorative gift boxes obviate the need to have a box separately gift-wrapped, and thus, it may be advantageous in convincing customers to make a purchase of merchandise in a store which provides a novel gift box. Competing stores are always on the lookout for more attractive gift boxes, particularly during the holiday season when the purchase of gifts increases significantly.

SUMMARY OF THE INVENTION

The invention provides a folding paperboard gift box having a generally square or rectangular cross section enclosure formed of four wall panels, which is closed at both ends by suitable end closures, each of which can constitute a plurality of end panels. Hingedly attached to one of these panels is a decorative design which, upon the setting up or squaring or the closing of the box, becomes spaced-apart from the surface of the panel from which it is attached and thus stands out prominently as a part of the completed box.

DETAILED DESCRIPTION OF THE PREFERRED EMBODIMENTS

Figure 1:
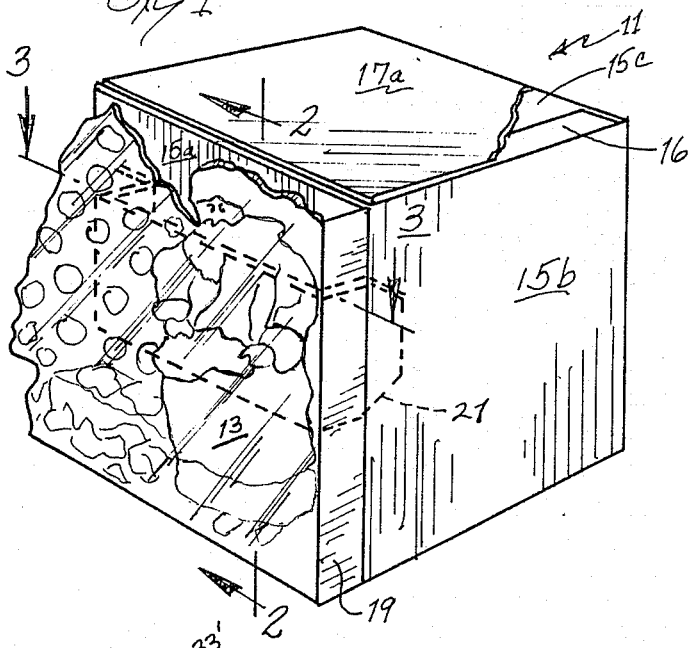
FIG. 1 is a perspective view of a gift box embodying various features of the invention, shown in its set-up, closed condition.

FIG. 1 shows a novel gift box 11 which has a separate decorative panel 13 that is attached to one of four side panels 15 which define the rectangular enclosure section of the box. The enclosure is closed by a pair of end panels 17 which are referred to as a top cover **17*a* and bottom cover 17*b***.

Figure 3:
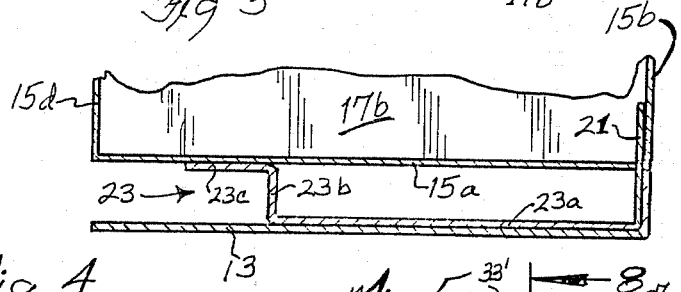
FIG. 3 is a horizontal sectional view, enlarged in size, taken generally along the line 3—3 of FIG. 1.
Figure 4:
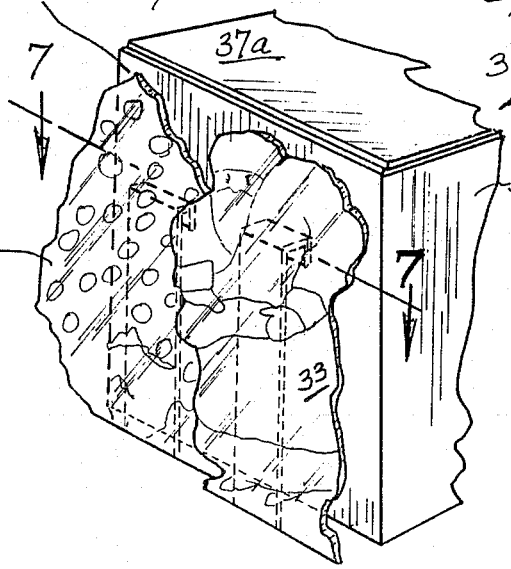
FIG. 4 is a perspective view of another gift box generally similar to that shown in FIG. 1 and having various features of the invention.

The gift box 11 is designed to fold flat for storage and shipping with the four side panels 15 folding into a flattened condition. The design panel 13 is die-cut or otherwise suitably formed into a decorative configuration which may, for example, illustrate a holiday scene or symbolize a special occasion. In the illustrated embodiment, the right hand edge of the die panel is hinged to a spacer panel 19 which extends back to the edge of the gift box. The design panel 13 is actuated by a lever 21 which is adhesively or otherwise affixed to the interior surface of the spacer panel 19 and which terminates in a tapered tab portion that extends through a slot provided in the front panel **15*a* of the gift box along its right hand edge. For convenience of assembly the lever 21 is formed from the same sheet material as a three-section hinge 23 which, as seen in FIG. 3, is generally of a Z-shape. It includes a section 23*a* which is adhesively or otherwise suitably affixed to the rear surface of the design panel 13, a connecting section 23*b* and a section 23*c* which is glued or otherwise suitably affixed to the front panel 15*a***.

Figure 2:
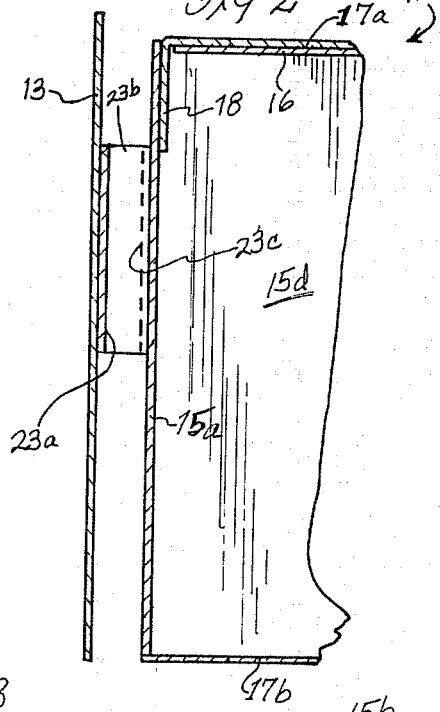
FIG. 2 is a side sectional view, enlarged in size, taken generally along the line 2—2 of the FIG. 1.

When the gift box is squared from its flat-folded condition to form the rectangular cross-section enclosure, as a part of the set-up of the box, the movement of the side panel **15*b* relative to the side panel 15*a* causes these two panels to move from a planar configuration to a configuration where they are at 90° to each other. As a result, the lever 21, which remains parallel to the panel 15*b* to which it is affixed, causes the design panel 13*a* to assume an extended position spaced from the front surface of the front side panel 15*a*. This movement causes the Z-hinge 23 to open up to the position shown in FIG. 3 where the connecting portion 23*b* similarly spaces the design panel 13 from the front surface of the panel 15*a*. Once the box has been squared, it is maintained in this position by the closure of the bottom panel 17*b*. Although this is shown as a single panel, it could be made up of any suitable configuration, such as four interlocking panels each of which is hinged to one of the side panels 15 and which together complete the bottom closure. As best seen in FIG. 2, the cover panel 17*a* is hinged to the rear side panel 15*c* and includes a front flap 18 hinged to its front edge which is inserted just interior of the front wall 15*a* to maintain the cover in the closed position. Moreover, the sidewalls 15*b* and 15*d* preferably have flanges 16 hinged to their upper edges which provide support for the top end panel 17*a*** when it is in the closed position.

Shown in FIGS. 4, 5, 6, 7, 8 and 9 is a generally similar gift box 31 which is formed from four side panels 35, a front panel **35*a*, a rear panel 35*c* and right and left side panels 35*b*, 35*d*. End panels are hinged as a top cover 37***a* to the top edge of the rear panel 35*c* and as a bottom cover 37*b* to the bottom edge of the front panel 35*a*. A pair of decorative panels 33 and 33' are arranged to lie generally flat against the front panel 35*a* in the flat-folded position and to stand spaced apart from the panel in the set-up condition of the gift box 31.

Figure 5:
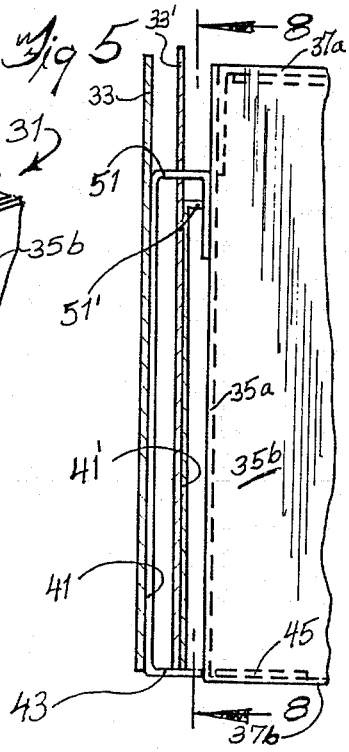
FIG. 5 is a side view, enlarged in size, of the box shown in FIG. 4.
Figure 7:
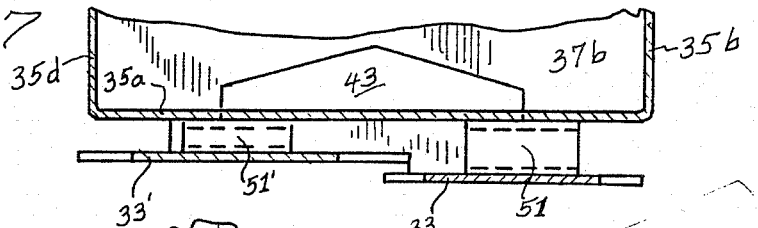
FIG. 7 is a horizontal sectional view taken generally along the line 7—7 of FIG. 4.
Figure 8:
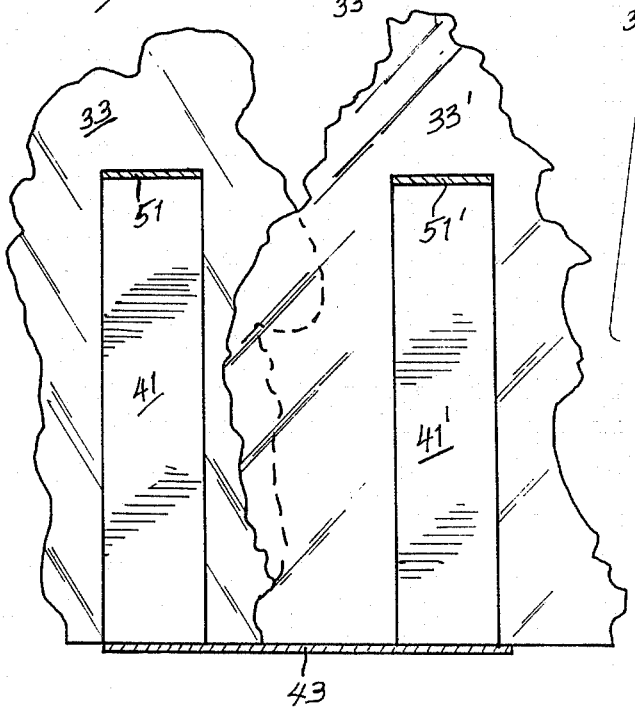
FIG. 8 is a vertical sectional view taken generally along the line 8—8 of FIG. 5.
Figure 9:
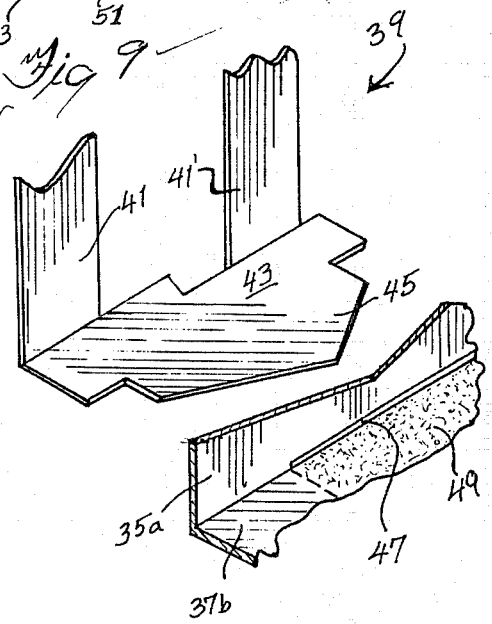
FIG. 9 is an exploded, fragmentary, perspective view looking at the box of FIG. 4 from generally the same viewpoint as FIG. 8.
Figure 10:
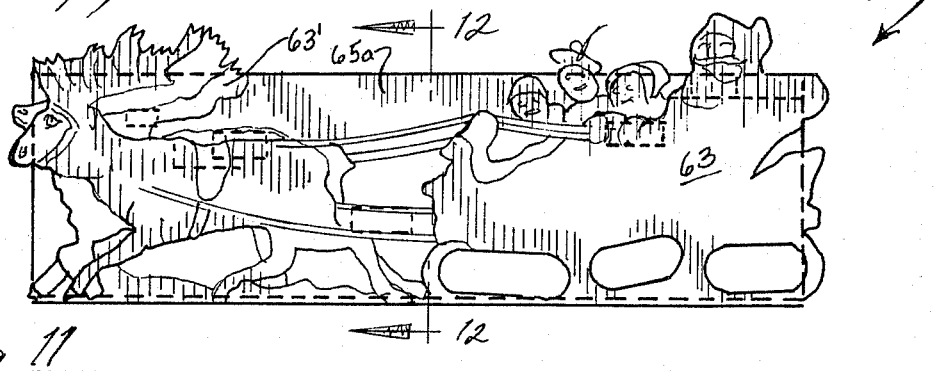
FIG. 10 is a front view of still another embodiment of a gift box embodying various features of the invention.
Figure 11:
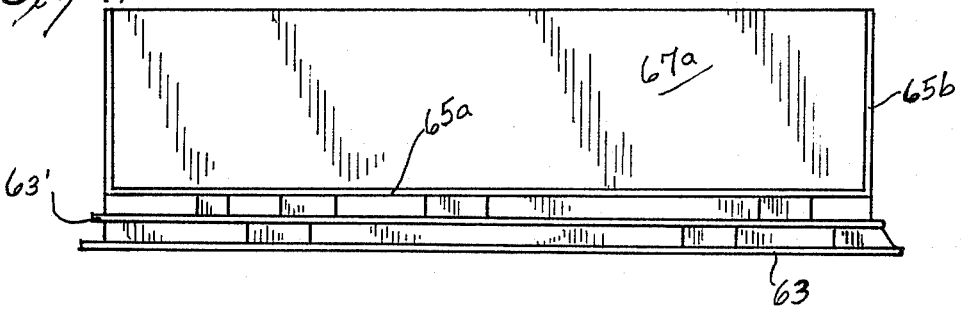
FIG. 11 is a top view of the box as shown in FIG. 10.

The details of the construction are best seen in FIGS. 5 through 9 where it can be observed that the decorative panels 33, 33' are mounted via a backing panel 39 which includes a pair of vertical strip portions 41, 41' that are hinged at the bottom to a lever panel 43 which terminates in a tab portion 45 that is received through a slot 47 in the bottom edge of the front panel 35*a*. The tab portion 45 is glued to the interior surface of the bottom cover 37*b* by a glue pattern 49 so that the lever panel 43 then moves integrally with the bottom cover 37*b*. The portion of the lever panel 43 that remains exterior of the gift box is preferably made from material similar to the bottom cover or printed to match the color of the box to present a uniform appearance if desired. The support panel 39 contains, at the upper ends of the strips 41, 41', a pair of hinges 51, 51' which as best seen in FIG. 5 are bent at 90° from the strips and then again at 90° to form end sections that are adhesively secured to the front surface of the front wall 35*a* of the gift box, thus spacing the upper portions of the decorative panels 33, 33' the same distance from the front of the box as the lower portions are spaced via the hinged connection to the lever panel 43.

Figure 6:
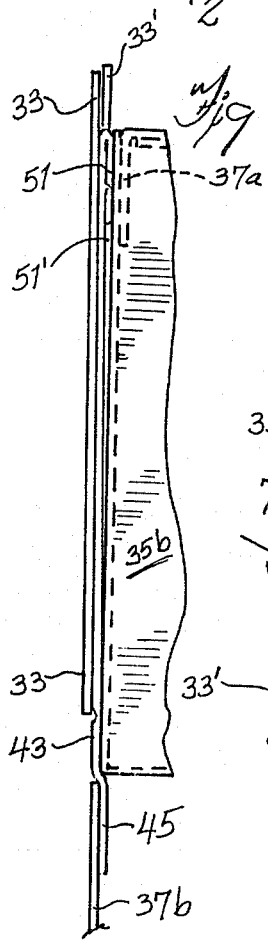
FIG. 6 is a side view of the box as shown in FIG. 4, similar to FIG. 5 but showing the box in the collapsed or flat-folded condition.

Thus, it can be seen that after the rectangular enclosure has been squared to set-up the gift box, the closing of the bottom cover 37*b* accomplishes the outward movement from the flat-folded condition shown in FIG. 6 to the extended condition shown in FIG. 5. Movement to the extended position occurs as a result of the pivoting of the lever arm portion 43, because of its adhesive connection to the bottom cover 37*b*, to a orientation perpendicular to the front side panel 35*a* from its flat-folded condition where it lies generally parallel to the plane of the front panel 35*a*.

Shown in FIGS. 10–13 is another type of gift box 61 which has a pair of decorative panels 63, 63' spaced apart from the front panel 65*a* in the set-up condition. Generally, the box 61 has four side panels 65 which form a rectangular enclosure that is closed by a top cover 67*a* that is hinged to the rear sidewall and has a plurality of bottom cover panels 67*b* which are individually hinged to the lower edges of the side panels and which interconnect with one another to form the bottom closure.

The lever panel 69 is formed from the same relatively stiff, sheet material as the front decorative panel 63, being connected along a hinge line 70 to the lower edge thereof. The lever arm panel 69 is adhesively affixed to the exterior surface of the bottom closure panel 67*b* that is hinged to the bottom edge of the front panel 65*a* and thus moves with it and has the same spatial orientation. The upper portion of the decorative front panel 63 is spaced by hinges 71 that are also formed from the same sheet material, being hinged to the upper edge of the decorative panel and having horizontal sections extending back therefrom at right angles which terminate in short tabs bent at right angles thereto. In this embodiment, these short tabs are adhesively affixed not to the front panel of the gift box but instead to the front surface of the decorative panel 63' which lies intermediate to the front panel 65*a* of the box and the decorative panel 63 for its entire width, as explained more fully hereinafter.

Figures 12, 13, 14, 15, 16, 17:
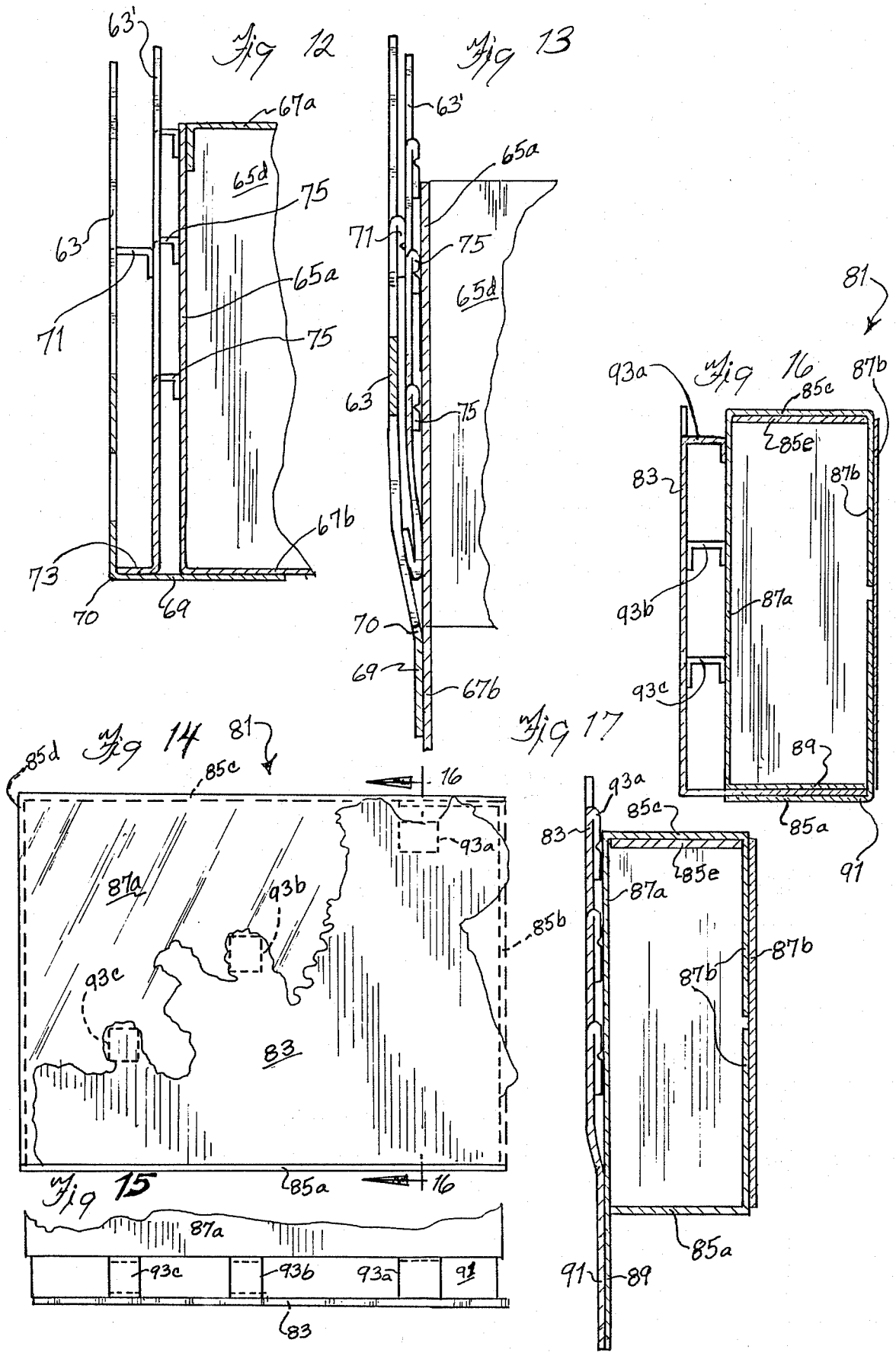
FIG. 12 is, a vertical sectional view, enlarged in size, taken along the line 12—12 of FIG. 10.
FIG. 13 is a view similar to FIG. 12 showing the decorative panel portion of the box of FIG. 10 in its flat-folded or collapsed condition.
FIG. 14 is a top view of yet another gift box embodying various features of the invention, wherein the design panel is attached to an end or top cover panel.
FIG. 15 is a fragmentary rear view of the box shown in FIG. 14.
FIG. 16 is a sectional view taken generally along the line 16—16 of FIG. 14.
FIG. 17 is a view similar to FIG. 16 with the box shown in its set-up condition but with the cover remaining in its flat-folded or collapsed condition.

The intermediate decorative panel 63' terminates in a lower flange 73 which is folded forward and affixed by adhesive to the upper surface of the lever arm 69, as best seen in FIG. 12. A plurality of hinges 75 are also formed from the same sheet material of the intermediate panel and are hinged to the upper edges of the decorative image, which hinges extend rearward at right angles to the panel 63', being adhesively affixed to the front surface of the front sidewall 65*a* of the gift box.

FIG. 13 shows the decorative images 63, 63' in the flat-folded condition but with the side panels 65 squared to form a rectangular enclosure. FIG. 12 then shows the completed, set-up box with both the end closures in place and the decorative panels 63, 63' in their extended positions. When the bottom panels 67*b* are folded closed position at right angles to the sidewalls, the lever arm panel 69 pivots to a position at right angles to the front panel 65*a* carrying with it the lower ends of the decorative panels 63, 63'. The intermediate decorative panel 63' moves away from the front surface of the panel 65*a* with its movement guided by the hinges 75. Simultaneously, the front decorative panel 63 moves away from the front surface of the intermediate panel 63' with its movement guided by the hinges 71, thus presenting the attractive arrangement depicted in FIG. 12.

Depicted in FIGS. 14–17 is a gift box 81 wherein the rectangular closure is of relatively shallow construction and a decorative panel 83 is arranged to lie adjacent its cover. More specifically, the enclosure is formed by four sidewalls 85*a*, 85*b*, 85*c* and 85*d* which are interconnected to one another via short flange 85*e* which is glued to the interior surface of the rear panel 85*c* to form the usual manufacturer's joint. A full cover 87*a* is hinged to the upper edge of the rear sidewall 85*c*. At its forward edge, the full cover 87*a* has a hinged tongue panel 89 which extends for the full depth of the box as best seen in FIG. 16. The bottom end closure of the gift box 81 is formed by four interconnecting panels 87*b* which are each respectively hinged to the lower edges of one of the sidewalls 85. The four bottom closure panels 87*b* may be joined via the usual tab and slot connections or may be joined as a result of a glued, self-locking panel construction, all as is well known in the art.

The decorative panel 83 is hinged along its lower or front edge to a lever arm panel 91 which is glued, as best seen in FIGS. 16 and 17, to the exterior surface of the tongue panel 89. A plurality of hinges 93 interconnect other portions of the decorative panel 83 and the cover 87*a* of the box. The hinges 93 may be formed from the sheet material of the decorative panel 83, as is the case of the hinge 93*a* which is hinged along the upper or rear edge of the decorative figure, or they may be made separately. As best seen in FIG. 16, the hinges 93*b* and 93*c* are formed separately and are glued to the rear surface of the panel 83 and to the front surface of the cover 87*a*.

FIG. 17 shows the box after the side panels have been squared to form the rectangular enclosure and the bottom panels 87*b* have also been interconnected to form the bottom closure; however, the cover 87*a* and the decorative panel 83 are still shown in their flat-folded storage position. FIG. 16 shows the box after the front tongue panel 89 has been pivoted to a right angle orientation to the cover panel 87*a* and inserted into the rectangular enclosure. The 90° pivoting of the tongue 89 causes the lever arm panel 91, which is glued to it, to be similarly moved to an orientation at right angles to the cover 87*a*. This movement causes the lever arm panel to move the hinged decorative panel 83 away from the surface of the cover 87*a* with the movement of the panel 83 being guided by the hinges 93*a*, 93*b* and 93*c*, which form a type of parallelogram linkage, between the cover 87*a* and the decorative panel 83 as best seen in FIG. 16 together with the lever arm panel 91. In the extended position, the decorative panel 83 is spaced from the cover a substantially uniform distance throughout its entirety. Optionally, if desired, the hinges could be of proportionately greater or lesser lengths so as to create a nonparallel orientation where the upper edge of the decorative panel 83 is either slightly nearer or slightly further from the cover 87*a* relative to its lower edge. Likewise, the lever arm panel 91 could be inserted through a slot in the cover and glued to the interior surface of the sidewall 85*c* or alternatively to the exterior surface thereof.

Although the invention has been described with regard to certain preferred embodiments, it should be understood that various modifications and changes could be made as would be obvious to one having the ordinary skill in the art. Portions of the decorative panel can be fashioned from the panels of the box itself, or they can all be fabricated separately and simply glued or otherwise adhesively connected to an existing box of the type that is fabricated to fold into a flat condition for storage. Likewise, the decorative panels can be hinged to the upper edge or the lower edge of a cover or to any one of the sidewalls of such a box which forms a rectangular enclosure. Although the invention has been disclosed with regard to these preferred embodiments, it should be understood that the scope of the invention is defined solely by the appended claims.

Particular features of the invention are emphasized in the claims which follow.

What is claimed is:

1. A gift box designed to fold flat for storage comprising four interconnected sidewall panel which form a rectangular enclosure having a first end opening and a second end opening, a first end wall panel attached to an upper edge of one of said sidewall panels and adapted to at least partially close said first end opening of said enclosure, a second end wall panel attached to a lower edge of one of said sidewall panels and adapted to at least partially close said second end opening of said enclosure, a design panel of decorative configuration lying generally adjacent to one of said sidewall panels, first hinge means attaching said design panel to one of said sidewall panels, and lever means interconnecting said design panel and one of said end wall panels so that actuating movement of said lever means causes said design panel to become spaced apart from said one panel, said lever means being hingedly connected to said design panel and being actuated as a result of the setting-up of said flat-folded giftbox to its operative configuration and the movement of said interconnected end wall panel to a closed position.

2. A gift box as described in claim 1 wherein a second design panel is provided and spaced further from said one sidewall panel than said design panel, said second design panel being attached by second hinge means to a front surface of said design panel and also being attached to said lever means.

3. A gift box designed to fold flat for storage comprising four interconnected sidewall panels which form a rectangular enclosure having a first end opening and a second end opening, a cover panel attached to an upper edge of one of said sidewall panels and adapted to close said first end opening of said enclosure, said cover panel having a hinged tongue section, an end wall panel attached to a lower edge of one of said sidewall panels and adapted to at least partially close said second end opening of said enclosure, a design panel of decorative configuration lying adjacent said cover panel, first hinge means attaching said design panel to said cover panel, and lever means interconnecting said design panel and said hinged tongue section so that actuating movement of said lever means causes said design panel to become spaced apart from said cover panel, said lever means being hingedly connected to said design panel and being actuated as a result of the closing of said cover panel upon the set-up giftbox.

4. A gift box designed to fold flat for storage comprising four interconnected sidewall panels which form a rectangular enclosure having a first end opening and a second end opening, a cover panel attached to an upper edge of one of said sidewall panels and adapted to close said first end opening of said enclosure, said cover panel having a hinged tongue section, an end wall panel attached to a lower edge of a sidewall panel and adapted to at least partially close said second end opening of said enclosure a design panel of decorative configuration lying adjacent said cover panel, first hinge means attaching said design panel to said cover panel, and lever means interconnecting said design panel and said one sidewall panel so that movement of said cover panel relative to said lever means causes said design panel to become spaced apart from said cover panel as a result said lever means being hingedly connected to said design panel, which movement occurs when said cover panel is moved to close said first end opening of the set-up giftbox.

* * * * *